US008439047B2

(12) United States Patent
Fournier et al.

(10) Patent No.: US 8,439,047 B2
(45) Date of Patent: May 14, 2013

(54) COMPOSITE MESOPOROUS/MICROPOROUS MATERIALS AND THEIR USE IN SMOKING ARTICLES FOR REMOVING CERTAIN GAS PHASE CONSTITUENTS FROM TOBACCO SMOKE

(75) Inventors: Jay A Fournier, Richmond, VA (US); Zhaohua Luan, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1867 days.

(21) Appl. No.: 10/740,583

(22) Filed: Dec. 22, 2003

(65) Prior Publication Data

US 2005/0133054 A1 Jun. 23, 2005

(51) Int. Cl.
*A24D 3/06* (2006.01)

(52) U.S. Cl.
USPC ..... 131/342; 131/202; 131/207

(58) Field of Classification Search ..... None
See application file for complete search history.

(56) References Cited

U.S. PATENT DOCUMENTS

| | | | | |
|---|---|---|---|---|
| 3,292,636 | A * | 12/1966 | Mays | 131/352 |
| 3,931,824 | A * | 1/1976 | Miano et al. | 131/359 |
| 5,098,684 | A | 3/1992 | Kresge et al. | |
| 5,102,643 | A | 4/1992 | Kresge et al. | |
| 5,108,725 | A | 4/1992 | Beck et al. | |
| 5,322,075 | A | 6/1994 | Deevi et al. | |
| 5,538,710 | A | 7/1996 | Guo et al. | |
| 5,591,368 | A | 1/1997 | Fleischhauer et al. | |
| 5,601,798 | A * | 2/1997 | Cooper et al. | 423/700 |
| 5,692,525 | A | 12/1997 | Counts et al. | |
| 5,727,573 | A * | 3/1998 | Meier et al. | 131/341 |
| 5,792,808 | A | 8/1998 | Sobuttka et al. | |
| 5,934,289 | A | 8/1999 | Watkins et al. | |
| 5,958,368 | A | 9/1999 | Ryoo et al. | |
| 6,037,292 | A | 3/2000 | Lai et al. | |

(Continued)

FOREIGN PATENT DOCUMENTS

| | | |
|---|---|---|
| CN | 1208718 | 2/1999 |
| CN | 1274616 | 11/2000 |

(Continued)

OTHER PUBLICATIONS

Meier et al., "Significant reduction of carcinogenic compounds in tobacco smoke by the use of zeolite catalysts", Microporous and Mesoporous Materials, Aug. 16, 1999, Elsevier, 33, pp. 307-310.*

(Continued)

*Primary Examiner* — Michael J Felton
(74) *Attorney, Agent, or Firm* — Buchanan Ingersoll & Rooney PC

(57) ABSTRACT

Cut filler compositions, cigarettes, methods for making cigarettes and methods for smoking cigarettes are provided, which involve the use of a composite mesoporous/microporous material. The composite material is capable of removing at least one constituent from tobacco smoke, preferably selectively. The composite material may also be used for removing at least one constituent from tobacco smoke through sorption and/or catalysis. The composite material comprises channels interconnecting at least one mesoporous region and at least one microporous region. The mesopores of the composite material may further comprise a carbon lining and/or be further functionalized with a surfactant. Alternatively, the composite material may further comprise a metal, a metal oxide, or mixtures thereof.

49 Claims, 3 Drawing Sheets

U.S. PATENT DOCUMENTS

| | | | |
|---|---|---|---|
| 6,053,176 | A | 4/2000 | Adams et al. |
| 6,209,547 | B1 | 4/2001 | Koller et al. |
| 6,245,698 | B1 | 6/2001 | Pope et al. |

FOREIGN PATENT DOCUMENTS

| | | |
|---|---|---|
| CN | 1304871 | 7/2001 |
| CN | 1304872 | 7/2001 |
| DE | 10013378 | 10/2001 |
| WO | 01/17901 | 3/2001 |
| WO | 01/38223 | 5/2001 |
| WO | 01/78886 | 10/2001 |

OTHER PUBLICATIONS de Jong, et al., "On the Shape of the Mesopores in Zeolite Y: A Three-Dimensional Transmission Electron Microscopy Study Combined with Texture Analysis" J. Phys. Chem. B, Oct. 24, 2002, American Chemical Society, 106, pp. 11905-11909.*

Glover, et al. "Carbon-silica composite adsorbent: Characterization and adsorption of light gases" Microporous and Mesoporous Materials, Elsevier, 111, Availble online Jul. 2007, pp. 1-11.*

Shan, Z. et al., "*Studies in Surface Science and Catalysis*", 141:635-640 (2002.

* cited by examiner

COMPOSITE MESOPOROUS/MICROPOROUS MATERIALS AND THEIR USE IN SMOKING ARTICLES FOR REMOVING CERTAIN GAS PHASE CONSTITUENTS FROM TOBACCO SMOKE

BACKGROUND

Certain filter materials have been suggested for incorporation into cigarette filters, including cotton, paper, cellulose, and certain synthetic fibers. However, such filter materials generally only remove particulate and condensable components from tobacco smoke. Thus, they are usually not optimal for the removal of certain gaseous components from tobacco smoke, e.g., volatile organic compounds.

SUMMARY

Cut tobacco filler, filter and paper compositions, cigarettes, methods for making cigarettes and methods for smoking cigarettes are provided which involve the use of a composite mesoporous/microporous material. In one embodiment, cut tobacco filler compositions are provided, which comprise tobacco, and a composite mesoporous/microporous material, wherein the composite mesoporous/microporous material is capable of removing at least one constituent from tobacco smoke.

In another embodiment, smoking articles are provided, which comprise a composite mesoporous/microporous material, wherein the composite mesoporous/microporous material is capable of removing at least one constituent from tobacco smoke. Examples of smoking articles include cigarettes, pipes, cigars and non-traditional cigarettes. Such smoking articles may comprise up to about 300 mg of the composite mesoporous/microporous material, or preferably greater than about 10 mg of the composite mesoporous/microporous material.

Examples of constituents in mainstream tobacco smoke that may be removed include, but are not limited to, aldehydes, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, and/or benzo(a)pyrene. Preferably, the composite mesoporous/microporous material is capable of removing at least one constituent from tobacco smoke through sorption and/or catalysis. The composite mesoporous/microporous material is present in an amount effective to remove some or all of at least one constituent from mainstream tobacco smoke; for example, preferably at least about 30% or more preferably at least about 50% of at least one constituent may be removed from mainstream tobacco smoke. Preferably, the composite mesoporous/microporous material is capable of selectively removing at least one constituent from tobacco smoke.

Preferably, the composite mesoporous/microporous material comprises mesopores having an average pore size from about 20 Å to about 500 Å. Preferably, the composite mesoporous/microporous material comprises a zeolite having an average pore size of less than about 20 Å. Examples of zeolite materials that may be used to make the composite mesoporous/microporous material include, but are not limited to, zeolites such as zeolite ZSM-5, zeolite A, zeolite X, zeolite Y, zeolite K-G, zeolite ZK-5, zeolite Beta, zeolite ZK-4, and mixtures thereof.

Preferably, the composite mesoporous/microporous material comprises channels interconnecting at least one mesoporous region and at least one microporous region. The mesopores of the composite mesoporous/microporous material may further comprise a carbon lining and/or be further functionalized with a surfactant. Alternatively, the composite mesoporous/microporous material may further comprise a metal or a metal oxide thereof. The metal or metal oxide thereof is preferably selected from one or more of a transition or lanthanide metal or a metalloid atom, e.g., such as those of Group IB-VIIIB, IIIA and IVA elements of the Periodic Table of Elements, and mixtures thereof, e.g., B, Al, Si, Ti, V, Mn, Fe, Co, Cu, Zn, Ge, Y, Zr, Nb, Mo, Rh, Pd, Ag, Ce, Hf, Ta, Re, Ir, Pt and Au. Particularly preferred metals are iron, copper, zinc, titanium, vanadium, silver, palladium, and/or manganese.

The composite mesoporous/microporous material may be dispersed in a cut tobacco filler, located in a paper wrapper and/or located in a filter portion. The filter portion may be a mono filter, a dual filter, a triple filter, a cavity filter, a recessed filter or a free-flow filter. The composite mesoporous/microporous material may be incorporated into one or more filter parts selected from the group consisting of: shaped paper insert, a plug, a space, cigarette filter paper, a cellulose acetate sleeve, a polypropylene sleeve, and a free-flow sleeve.

In yet another embodiment, methods of making a cigarette are provided, which comprise (i) adding at least one composite mesoporous/microporous material to a cut tobacco filler, wherein the composite mesoporous/microporous material is capable of removing at least one constituent from tobacco smoke; (ii) providing the cut tobacco filler comprising the composite mesoporous/microporous material to a cigarette making machine to form a tobacco column; and (iii) placing a paper wrapper around the tobacco column to form a tobacco rod of a cigarette.

In another embodiment, a method for making a cigarette comprises (i) providing a cut tobacco filler to a cigarette making machine to form a tobacco column; (ii) placing a paper wrapper around the tobacco column to form a tobacco rod; and (iii) attaching a cigarette filter to the tobacco rod using tipping paper to form the cigarette, wherein the cigarette filter comprises at least one composite mesoporous/microporous material capable of removing at least one constituent from mainstream tobacco smoke.

An embodiment further relates to methods for making a cigarette, which comprise (i) providing the cut tobacco filler to a cigarette making machine and forming a tobacco column; and (ii) placing a paper wrapper around the tobacco column to form a tobacco rod of the cigarette, wherein the paper wrapper comprises at least one composite mesoporous/microporous material that is capable of removing at least one constituent from sidestream tobacco smoke.

Another embodiment relates to methods for making a cigarette filter, comprising incorporating at least one composite mesoporous/microporous material that is capable of removing at least one constituent from mainstream tobacco smoke into a cigarette filter.

Yet another embodiment relates to methods of smoking a cigarette containing a composite mesoporous/microporous material, which comprises lighting the cigarette to form smoke and drawing the smoke through the cigarette, wherein during the smoking of the cigarette, the composite mesoporous/microporous material removes at least one constituent from mainstream tobacco smoke.

DETAILED DESCRIPTION

Figure 1:
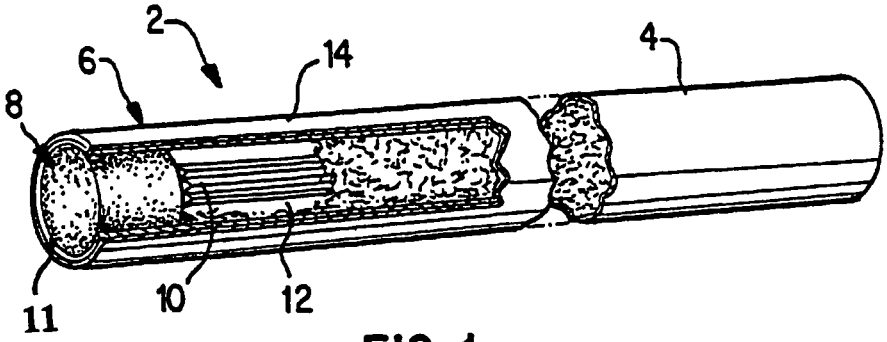
FIG. 1 is a partially exploded perspective view of a cigarette incorporating one embodiment wherein folded paper containing a composite mesoporous/microporous material is inserted into a hollow portion of a tubular filter element of the cigarette.

Cut tobacco filler compositions, smoking articles such as cigarettes, methods for making cigarettes and methods for smoking cigarettes are provided which involve the use of a composite mesoporous/microporous material to remove one or more constituents from mainstream and sidestream tobacco smoke. The term "mainstream" smoke refers to the mixture of gases issuing through the mouth or filter end of a smoking article, e.g. the amount of smoke issuing or drawn from the mouth end of a cigarette during smoking of the cigarette.

Composite mesoporous/microporous material is used for selective and effective removal of certain selected constituents of mainstream tobacco smoke. Preferably, other constituents in mainstream smoke, i.e. such as those that contribute to flavor, will not be targeted for removal. By "removed" is meant that the concentration of at least some of at least one constituent in mainstream smoke is lowered. This can be accomplished by a variety of mechanisms. For example, the constituent may chemically react with the composite mesoporous/microporous material. Alternatively, the constituents may be sequestered within the pores of the composite mesoporous/microporous material, and thus removed from the tobacco smoke before reaching the smoker or being given off as second-hand smoke.

By "selective removal" is meant that certain constituents are substantially removed from mainstream smoke, while other constituents are not substantially removed. The term "selective" also encompasses "preferential" removal of certain constituents from mainstream smoke, i.e. where more than one constituent may be removed, but where one constituent is removed to a greater extent than another component.

The composite mesoporous/microporous material may remove one or more constituents from mainstream smoke through a combination of sorption and/or catalysis. The term "sorption" denotes filtration through absorption and/or adsorption. Sorption is intended to cover interactions on the outer surface of the composite mesoporous/microporous material, as well as interactions within the pores and channels of the sorbent. In other words, a sorbent is a substance that has the ability to condense or hold molecules of other substances on its surface and/or the ability to take up another substance, i.e. through penetration of the other substance into its inner structure or into its pores. The term "adsorption" also denotes filtration through physical sieving, i.e. capture of certain constituents in the pores of the composite mesoporous/microporous material. The term "sorbent" as used herein refers to either an adsorbent, an absorbent, or a substance that functions as both an adsorbent and an absorbent.

As used herein, the term "composite mesoporous/microporous material" covers a mesoporous molecular sieve material that is made from microporous starting materials or intermediate synthesis gel for microporous materials. The microporous material that makes up the composite mesoporous/microporous material product still retains microporous properties, i.e. an average pore size of about less than 20 Å, in the final composite mesoporous molecular sieve structure. Accordingly, the composite structure will have both microporous regions and mesoporous regions, which preferably have inter-connected channels. The composite mesoporous/microporous material preferably has increased catalytic ability, sorption, and/or selectivity as a result of its structure.

In a preferred embodiment, a modified procedure for preparing mesoporous molecular sieves may be used, where the microporous component is used as a source of silica to make mesoporous molecular sieves. Exemplary mesoporous silicates are described, for example, in patents relating to MCM-41 and MCM-48 and SBA-15; such as U.S. Pat. Nos. 5,108,725; 5,098,684 and 5,102,643, which are all hereby incorporated by reference in their entirety. See also, e.g., Shan, Z. et al., *Studies in Surface Science and Catalysis* 141:635-640 (2002). Typically, the microporous component, e.g. a semi-finished synthesis gel for microporous zeolites, is homogenously dispersed in a solvent such as water, along with silica sources such as tetraethyl orthosilicate (TEOS), along with organic amphiphilic surfactant templates that are suitable for the synthesis of mesoporous materials. Exemplary organic templates include but are not limited to, cetyltrimethylammonium bromide solution (cTAB) or block copolymes, such as: poly(ethylene glycol)-block-poly(propylene glycol)-block-poly(ethylene glycol). While not wishing to be bound by theory, it is believed that the zeolite microcrystalline particles organize into arrays along the organic template, which leads to the synthesis of the mesoporous molecular sieves under certain pH value and temperature. The resulting solid product is filtered and dried. The organic templates are typically removed through calcination, to generate a mesoporous porosity, which is linked to the microporous channels associated with the zeolite.

The composite mesoporous/microporous material, as described above, may be provided along the length of a tobacco rod by distributing the composite mesoporous/microporous material in the form of a powder on the tobacco or incorporating it into the cut tobacco filler tobacco using any suitable method. For instance, the composite mesoporous/microporous material may be provided to the cut tobacco filler in the form of a dry powder or in a dispersion with a suitable solvent. In a preferred method, the composite mesoporous/microporous material in the form of a dry powder is dusted on the cut tobacco filler tobacco. The composite mesoporous/microporous material may also be present in the form of a solution and sprayed on the cut tobacco filler. Alternatively, the tobacco may be coated with a solution containing the composite mesoporous/microporous material. The composite mesoporous/microporous material may also be added to the cut tobacco filler stock supplied to the cigarette making machine or added to a tobacco column prior to wrapping cigarette paper around the cigarette rod.

Any conventional or modified cigarette making technique may be used to incorporate the composite mesoporous/microporous material. The resulting cigarettes can be manufactured to any known specifications using standard or modified cigarette making techniques and equipment. Typically, the cut tobacco filler composition is optionally combined with other cigarette additives, and provided to a cigarette making machine to produce a tobacco rod, which is then wrapped in cigarette paper, and optionally tipped with filters.

Any suitable tobacco mixture may be used for the cut tobacco filler. Examples of suitable types of tobacco materials include flue-cured, Burley, Md. or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The cut filler may include tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives, e.g. burn additives, combustion modifying agents, coloring agents, binders, etc.

The cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 $mg/cm^3$ to about 300 $mg/cm^3$, and preferably 150 $mg/cm^3$ to about 275 $mg/cm^3$.

"Smoking" of a cigarette includes the heating or combustion of the cigarette to form smoke, and drawing the smoke through the smoking article. Generally, smoking of a cigarette involves lighting one end of the cigarette and drawing the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289, 5,591,368 or 5,322,075, for example.

Any conventional or modified method of making cigarette filters may be used to incorporate the composite mesoporous/microporous material. For example, various cigarette filter arrangements and methods for making filters are described in commonly-assigned U.S. Pat. No. 6,209,547, which is hereby incorporated in its entirety.

FIG. 1 illustrates a cigarette 2 having a tobacco rod 4, a filter portion 6, and a mouthpiece filter plug 8. As shown, a composite mesoporous/microporous material can be loaded onto folded paper 10 inserted into a hollow cavity such as the interior of a free-flow sleeve 12 forming part of the filter portion 6.

Figure 2:
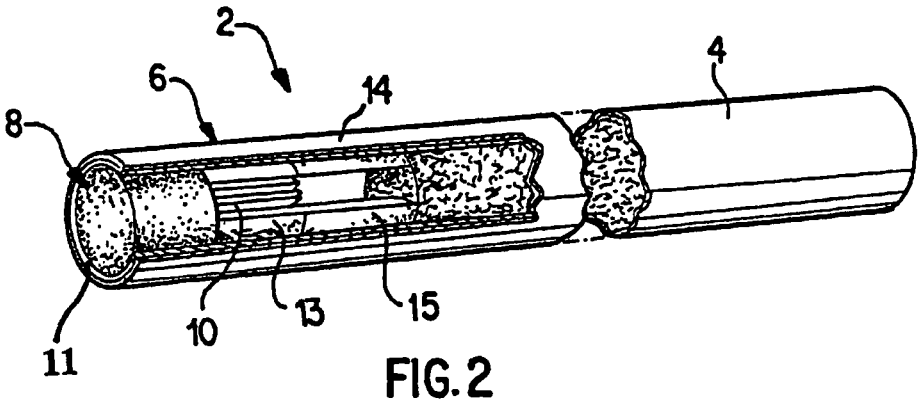
FIG. 2 is partially exploded perspective view of another embodiment wherein a composite mesoporous/microporous material is incorporated in folded paper and inserted into a hollow portion of a first free-flow sleeve of a tubular filter element next to a second free-flow sleeve.

FIG. 2 shows a cigarette 2 having a tobacco rod 4 and a filter portion 6, wherein the folded paper 10 is located in the hollow cavity of a first free-flow sleeve 13 located between the mouthpiece filter 8 and a second free-flow sleeve 15. The paper 10 can be used in forms other than as a folded sheet. For instance, the paper 10 can be deployed as one or more individual strips, a wound roll, etc. In whichever form, a desired amount of a composite mesoporous/microporous material can be provided in the cigarette filter portion by a combination of the coated amount of reagent/area of the paper and/or the total area of coated paper employed in the filter (e.g., higher amounts of a composite mesoporous/microporous material can be provided simply by using larger pieces of coated paper). In the cigarettes shown in FIGS. 1 and 2, the tobacco rod 4 and the filter portion 6 are joined together with tipping paper 14. In both cigarettes, the filter portion 6 may be held together by filter overwrap 11.

A composite mesoporous/microporous material can be incorporated into the filter paper in a number of ways. For example, a composite mesoporous/microporous material can be mixed with water to form a slurry. The slurry can then be coated onto pre-formed filter paper and allowed to dry. The filter paper can then be incorporated into the filter portion of a cigarette in the manner shown in FIGS. 8 and 9. Alternatively, the dried paper can be wrapped into a plug shape and inserted into a filter portion of the cigarette. For example, the paper can be wrapped into a plug shape and inserted as a plug into the interior of a free-flow filter element such as a polypropylene or cellulose acetate sleeve. In another arrangement, the paper can comprise an inner liner of such a free-flow filter element.

Alternatively and preferably, a composite mesoporous/microporous material is added to the filter paper during the paper-making process. For example, a composite mesoporous/microporous material can be mixed with bulk cellulose to form a cellulose pulp mixture. The mixture can be then formed into filter paper according to any conventional or modified methods.

Figure 3:
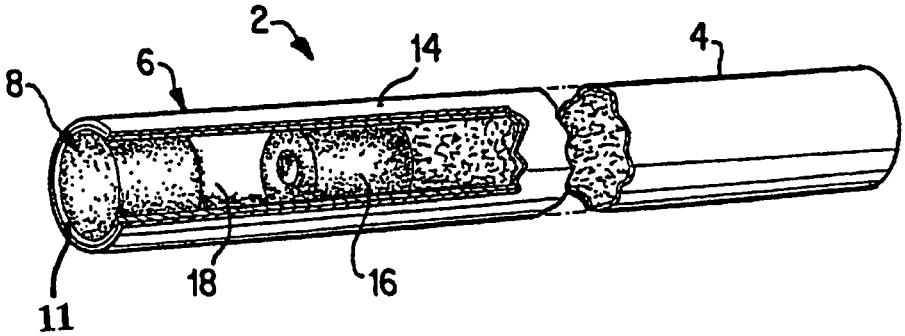
FIG. 3 is a partially exploded perspective view of another embodiment wherein a composite mesoporous/microporous material is incorporated in a plug-space-plug filter element.

In another preferred embodiment, a composite mesoporous/microporous material is incorporated into the fibrous material of the cigarette filter portion itself. Such filter materials include, but are not limited to, fibrous filter materials including paper such as tipping paper or plugs of fibers such as cellulose acetate fibers and polypropylene fibers. This embodiment is illustrated in FIG. 3, which shows a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 are joined together with tipping paper 14. The filter portion 6 may include a filter overwrap 11. The filter overwrap 11 containing traditional fibrous filter material and a composite mesoporous/microporous material can be incorporated in or on the filter overwrap 11 such as by being coated thereon. Alternatively, a composite mesoporous/microporous material can be incorporated in the mouthpiece filter 8, in the plug 16, and/or in the space 18. Moreover, a composite mesoporous/microporous material can be incorporated in any element of the filter portion of a cigarette. For example, the filter portion may consist only of the mouthpiece filter 8 and a composite mesoporous/microporous material can be incorporated in the mouthpiece filter 8 and/or in the tipping paper 14.

Figure 4:
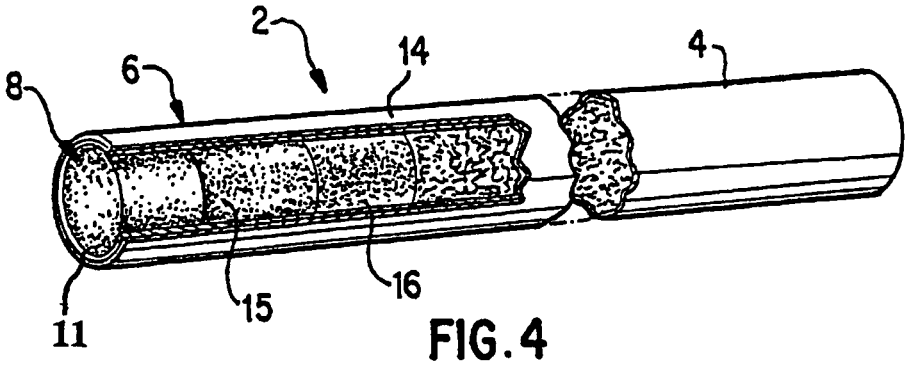
FIG. 4 is a partially exploded perspective view of another embodiment wherein a composite mesoporous/microporous material is incorporated in a three-piece filter element having three plugs.

FIG. 4 shows a cigarette 2 comprised of a tobacco rod 4 and filter portion 6. This arrangement is similar to that of FIG. 3 except the space 18 is filled with granules of a composite mesoporous/microporous material or a plug 15 made of material such as fibrous polypropylene or cellulose acetate containing a composite mesoporous/microporous material. As in the previous embodiment, the plug 16 can be hollow or solid and the tobacco rod 4 and filter portion 6 are joined together with tipping paper 14. There is also a filter overwrap 11.

Figure 5:
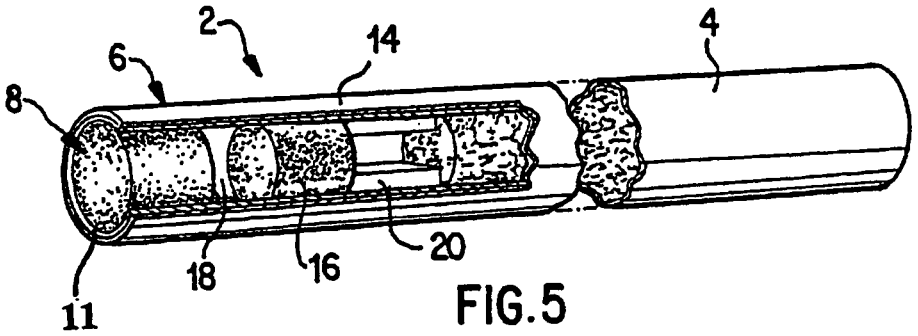
FIG. 5 is a partially exploded perspective view of another embodiment wherein a composite mesoporous/microporous material is incorporated in a four-piece filter element having a plug-space-plug arrangement and a hollow sleeve.

FIG. 5 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. A composite mesoporous/microporous material can be incorporated into one or more elements of the filter portion 6. For instance, a composite mesoporous/microporous material can be incorporated into the sleeve 20 or granules of a composite mesoporous/microporous material can be filled into the space within the sleeve 20. If desired, the plug 16 and sleeve 20 can be made of material such as fibrous polypropylene or cellulose acetate containing a composite mesoporous/microporous material. As in the previous embodiment, the plug 16 can be hollow or solid.

Figure 6:
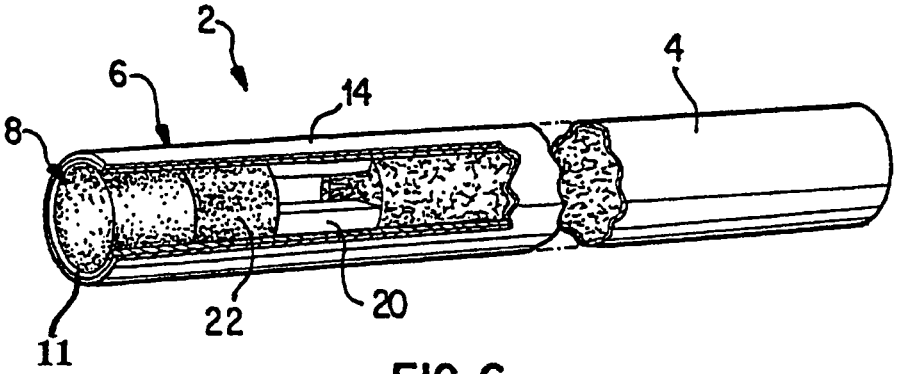
FIG. 6 is a partially exploded perspective view of another embodiment wherein a composite mesoporous/microporous material is incorporated in a three-part filter element having two plugs and a hollow sleeve.
Figure 7:
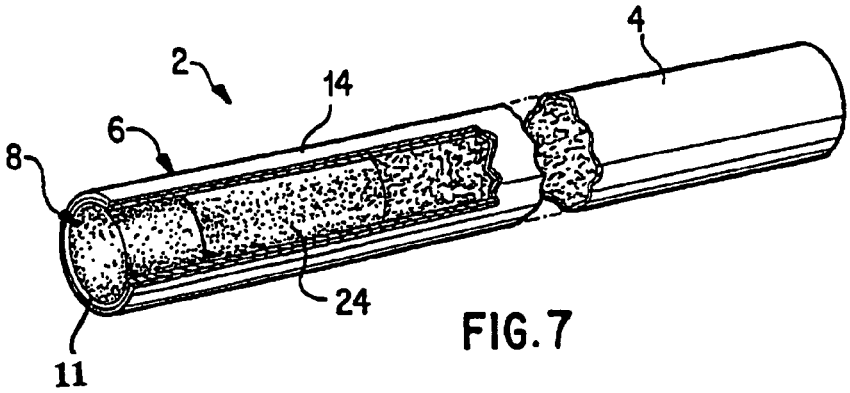
FIG. 7 is a partially exploded perspective view of another embodiment wherein a composite mesoporous/microporous material is incorporated in a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, and a composite mesoporous/microporous material can be incorporated in one or more of these filter elements. In FIG. 7, the filter portion 6 includes a mouthpiece filter 8 and a plug 24, and a composite mesoporous/microporous material can be incorporated in one or more of these filter elements. Like the plug 16, the plugs 22 and 24 can be solid or hollow. In the cigarettes shown in FIGS. 6 and 7, the tobacco rod 4 and filter portion 6 are joined together by tipping paper 14.

Various techniques can be used to apply a composite mesoporous/microporous material to filter fibers or other substrate supports. For example, a composite mesoporous/microporous material can be added to the filter fibers before they are formed into a filter cartridge, e.g., a tip for a cigarette. A composite mesoporous/microporous material can be added to the filter fibers, for example, in the form of a dry powder or a slurry. If a composite mesoporous/microporous material is applied in the form of a slurry, the fibers are allowed to dry before they are formed into a filter cartridge.

In another preferred embodiment, a composite mesoporous/microporous material is employed in a hollow portion of a cigarette filter. For example, some cigarette filters have a plug/space/plug configuration in which the plugs comprise a fibrous filter material and the space is simply a void between the two filter plugs. That void can be filled with a composite mesoporous/microporous material. An example of this embodiment is shown in FIG. 3. The composite mesoporous/microporous material can be in granular form or can be loaded onto a suitable support such as a fiber or thread.

Figure 8:
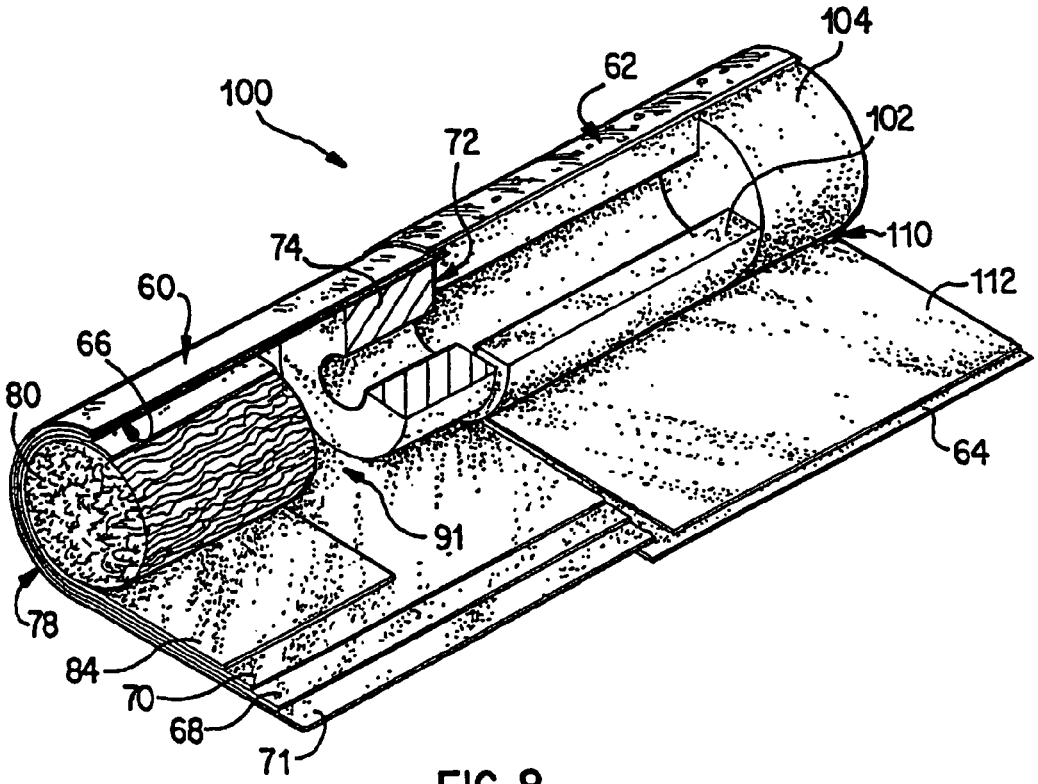
FIG. 8 is a partially exploded perspective view of another embodiment wherein a composite mesoporous/microporous material is incorporated in a filter element which may be used in a smoking article.

In another embodiment, the composite mesoporous/microporous material is employed in a filter portion of a cigarette for use with a smoking device as described in commonly-assigned U.S. Pat. No. 5,692,525, the entire content of which is hereby incorporated by reference. FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating a composite mesoporous/microporous material of the invention.

In such a cigarette, a composite mesoporous/microporous material can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, a composite mesoporous/microporous material can be incorporated into the fibrous wall portions of the tubular free-flow filter element 102 itself. For instance, the tubular free-flow filter element or sleeve 102 can be made of suitable materials such as polypropylene or cellulose acetate fibers and a composite mesoporous/microporous material can be mixed with such fibers prior to or as part of the sleeve forming process.

In another embodiment, a composite mesoporous/microporous material can be incorporated into the mouthpiece filter plug 104 instead of in the element 102. However, as in the previously described embodiments, a composite mesoporous/microporous material may be incorporated into more than one constituent of a filter portion such as by being incorporated into the mouthpiece filter plug 104 and into the tubular free-flow filter element 102. The filter portion 62 of FIG. 8 can also be modified to create a void space into which a composite mesoporous/microporous material can be inserted.

As explained above, the composite mesoporous/microporous material can be incorporated in various support materials. When a composite mesoporous/microporous material is used in filter paper, the composite mesoporous/microporous material can be incorporated in or formed into particles having average particle size of up to 100 μm, preferably less than 30 μm. When the composite mesoporous/microporous material is used in granular form, larger particles may be used. Such particles can be formed by using a binding material, such as clay, alumina, silica, as commonly used for catalyst production, and preferably have a mesh size of from 20 to 60 mesh (850 to 250 microns, U.S. Standard, ASTM E11), and more preferably from 35 to 60 mesh (500 to 250 microns). To form such particles, larger particles of the composite mesoporous/microporous material with binding material can be broken up into smaller particles having a desired size by any suitable technique, such as milling. The smaller particles can be separated to produce a desired particle size range by any suitable technique, such as sieving.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A cut filler composition comprising tobacco and a composite mesoporous-microporous material, wherein the composite mesoporous-microporous material is capable of removing at least one constituent from tobacco smoke.

2. A cut filler composition of claim 1, wherein the composite mesoporous-microporous material is capable of selectively removing at least one constituent from tobacco smoke.

3. A cut filler composition of claim 1, wherein the at least one constituent is selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, benzo(a)pyrene and mixtures thereof.

4. A cut filler composition of claim 1, wherein the composite mesoporous-microporous material is capable of removing at least one constituent from tobacco smoke through sorption.

5. A cut filler composition of claim 1, wherein the composite mesoporous-microporous material is capable of removing at least one constituent from tobacco smoke through catalysis.

6. A cut filler composition of claim 1, wherein the composite mesoporous-microporous material is present in an amount effective to remove at least 30% of at least one constituent from tobacco smoke.

7. A cut filler composition of claim 1, wherein the composite mesoporous-microporous material is present in an amount effective to remove at least 50% of at least one constituent from tobacco smoke.

8. A cut filler composition of claim 1, wherein the composite mesoporous-microporous material comprises a zeolite having an average pore size of less than about 20 Å.

9. A cut filler composition of claim 1, wherein the composite mesoporous-microporous material comprises a zeolite selected from the group consisting of zeolite ZSM-5, zeolite A, zeolite X, zeolite Y, zeolite K-G, zeolite ZK-5, zeolite Beta, zeolite ZK-4, and mixtures thereof.

10. A cut filler composition of claim 1, wherein the composite mesoporous-microporous material comprises mesopores having an average pore size from about 20 Å to about 500 Å.

11. A cut filler composition of claim 1, wherein the composite mesoporous-microporous material comprises channels interconnecting at least one mesoporous region and at least one microporous region.

12. A cut filler composition of claim 1, wherein the composite mesoporous-microporous material further comprises a metal, a metal oxide, or mixtures thereof.

13. A cut filler composition of claim 1, wherein the composite mesoporous-microporous material comprises at least one metal or metal oxide thereof selected from the group consisting of Group IB, IIB, IIIB, IVB, VB, VIB, VIIB, VIIIB, IIIA and IVA elements of the Periodic Table of Elements.

14. A cut filler composition of claim 1, wherein the composite mesoporous-microporous material comprises at least one metal or metal oxide thereof selected from the group consisting of iron, copper, zinc, titanium, vanadium, silver, palladium, and manganese.

15. A cut filler composition of claim 1, wherein the composite mesoporous-microporous material is further functionalized with a surfactant.

16. A cut filler composition of claim 1, wherein the composite mesoporous-microporous material is further functionalized with an aminopropyl group.

17. A smoking article comprising a composite mesoporous-microporous material, wherein the composite mesoporous-microporous material is capable of removing at least one constituent from tobacco smoke.

18. A smoking article of claim 17, wherein the composite mesoporous-microporous material is capable of selectively removing at least one constituent from tobacco smoke.

19. A smoking article of claim 17, wherein the at least one constituent is selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, benzo(a)pyrene, and mixtures thereof.

20. A smoking article of claim 17, wherein the composite mesoporous-microporous material is capable of removing at least one constituent from tobacco smoke through sorption.

21. A smoking article of claim 17, wherein the composite mesoporous-microporous material is capable of removing at least one constituent from tobacco smoke through catalysis.

22. A smoking article of claim 17, wherein the composite mesoporous-microporous material is present in an amount effective to remove at least 30% of at least one constituent from mainstream tobacco smoke.

23. A smoking article of claim 17, wherein the composite mesoporous-microporous material is present in an amount effective to remove at least 50% of at least one constituent from mainstream tobacco smoke.

24. A smoking article of claim 17, wherein the composite mesoporous-microporous material comprises a zeolite having an average pore size of less than about 20 Å.

25. A smoking article of claim 17, wherein the composite mesoporous-microporous material comprises a zeolite selected from the group consisting of zeolite ZSM-5, zeolite A, zeolite X, zeolite Y, zeolite K-G, zeolite ZK-5, zeolite Beta, zeolite ZK-4, and mixtures thereof.

26. A smoking article of claim 17, wherein the composite mesoporous-microporous material comprises mesopores having an average pore size from about 20 Å to about 500 Å.

27. A smoking article of claim 17, wherein the composite mesoporous-microporous material comprises channels interconnecting at least one mesoporous region and at least one microporous region.

28. A smoking article of claim 17, wherein the composite mesoporous-microporous material further comprises a metal, a metal oxide, or mixtures thereof.

29. A smoking article of claim 17, wherein the composite mesoporous-microporous material comprises at least one metal or metal oxide thereof selected from the group consisting of Group IB, IIB, IIIB, IVB, VB, VIB, VIIB, VIIIB, IIIA and IVA elements of the Periodic Table of Elements.

30. A smoking article of claim 17, wherein the composite mesoporous-microporous material comprises at least one metal or metal oxide thereof selected from the group consisting of iron, copper, zinc, titanium, vanadium, silver, palladium, and manganese.

31. A smoking article of claim 17, wherein the composite mesoporous-microporous material is further functionalized with a surfactant.

32. A smoking article of claim 17, wherein the composite mesoporous-microporous material is further functionalized with an aminopropyl group.

33. A smoking article of claim 17, wherein the smoking article comprises up to about 300 mg of the composite mesoporous-microporous material.

34. A smoking article of claim 17, wherein the smoking article comprises greater than about 10 mg of the composite mesoporous-microporous material.

35. A smoking article of claim 17, wherein the composite mesoporous-microporous material is in the form of a powder, granules, monolith or mixtures thereof.

36. A smoking article of claim 17, wherein the smoking article is selected from the group consisting of cigarette, pipe, cigar and non-traditional cigarette.

37. A smoking article of claim 36, wherein the smoking article is a cigarette.

38. A smoking article of claim 17, wherein the composite mesoporous-microporous material is dispersed in a cut tobacco filler.

39. A smoking article of claim 17, wherein the composite mesoporous-microporous material is located in a paper wrapper.

40. A smoking article of claim 17, wherein the composite mesoporous-microporous material is located in a filter portion.

41. A smoking article of claim 40, wherein the filter portion is a mono filter, a dual filter, a triple filter, a cavity filter, a recessed filter or a free-flow filter.

42. A smoking article of claim 40, wherein the composite mesoporous-microporous material is incorporated into one or more filter parts selected from the group consisting of: shaped paper insert, a plug, a space, cigarette filter paper, a cellulose acetate sleeve, a polypropylene sleeve, and a free-flow sleeve.

43. A method of making a cigarette, comprising (i) adding at least one composite mesoporous-microporous material to a cut filler, wherein the composite mesoporous-microporous material is capable of removing at least one constituent from tobacco smoke;

(ii) providing the cut filler comprising the composite mesoporous-microporous material to a cigarette making machine to form a tobacco column; and (iii) placing a paper wrapper around the tobacco column to form the cigarette.

44. A method of making a cigarette, the method comprising:

(i) providing a cut filler to a cigarette making machine to form a tobacco column;

(ii) placing a paper wrapper around the tobacco column to form a tobacco rod; and (iii) attaching a cigarette filter to the tobacco rod using tipping paper to form the cigarette, wherein the cigarette filter comprises at least one composite mesoporous-microporous material capable of removing at least one constituent from mainstream tobacco smoke.

45. A method of making a cigarette, comprising (i) providing the cut filler to a cigarette making machine to form a tobacco column; and (ii) placing a paper wrapper around the tobacco column to form a tobacco rod of the cigarette, wherein the paper wrapper comprises at least one composite mesoporous-microporous material that is capable of removing at least one constituent from sidestream tobacco smoke.

46. A method of making a cigarette filter, comprising incorporating at least one composite mesoporous-microporous material that is capable of removing at least one constituent from mainstream tobacco smoke into a cigarette filter.

47. A method of smoking the cigarette of claim 37, comprising lighting or heating the cigarette to form smoke and drawing the smoke through the cigarette, wherein during the smoking of the cigarette, the composite mesoporous-microporous material removes at least one constituent from mainstream tobacco smoke.

48. The cut filler composition of claim 1, wherein the composite mesoporous-microporous material includes microporous material having an average pore size of less than 20 Å and mesoporous material having an average pore size of 20 Å to 500 Å.

49. The smoking article of claim 17, wherein the composite mesoporous-microporous material includes microporous material having an average pore size of less than 20 Å and mesoporous material having an average pore size of 20 Å to 500 Å.

* * * * *